United States Patent [19]

Pribyl

[11] 4,406,385

[45] Sep. 27, 1983

[54] FILM CARRIER

[75] Inventor: George Pribyl, Bloomington, Minn.

[73] Assignee: Pribyl & Associates, Inc., Bloomington, Minn.

[21] Appl. No.: 290,947

[22] Filed: Aug. 7, 1981

[51] Int. Cl.[3] ..... A45F 5/00

[52] U.S. Cl. ..... 224/252; 224/253; 224/269; 224/908

[58] Field of Search ..... 224/908, 907, 269, 256, 224/253, 252, 251, 246, 240, 236, 170, 171; 220/23.4, 23.83, 23.86; 206/389, 316, 103, 86, 3

[56] References Cited

U.S. PATENT DOCUMENTS

| | | | |
|---|---|---|---|
| 1,556,127 | 10/1925 | Pruett | 224/252 |
| 3,355,061 | 11/1967 | Ritter | 206/389 |
| 4,082,201 | 4/1978 | Bittel | 220/339 |
| 4,180,192 | 12/1979 | Breslau | 206/316 |

*Primary Examiner*—Steven M. Pollard
*Assistant Examiner*—David Voorhees
*Attorney, Agent, or Firm*—James R. Cwayna

[57] ABSTRACT

A storage container particularly designed to hold and retain rolls of film or the like which includes a longitudinally arranged housing with a snap type cover element. The container housing includes a clip structure which is pressure responsive and pressure applying such that the container may be mounted on the carrying strap of a camera, a camera accessory strap or the users belt. The clip is integrally molded to the container and is designed to apply pressure to the strap upon which it is mounted. The unit also provides a connective strap extending from the housing to the cover element such that the cover will not be entirely separable from the housing and possibly misplaced.

4 Claims, 10 Drawing Figures

FILM CARRIER

FIELD OF THE INVENTION

This invention relates generally to containers and their associated cover elements and more particularly to a container and associated cover element which is designed to hold a roll of film and which includes a pressure applying clip integrally molded to the container the clip being flexible to receive a strap or the like therein and thereafter hold to the same with pressure.

SHORT SUMMARY OF THE INVENTION

A container for rolls of film or the like which includes a longitudinally extending housing having a radially extending lip on the open end thereof to receive a closure or cover element thereover, the closure element having a snap type connection to the housing over the radially extending lip. The container includes an integrally molded step receiving portion and the cover includes an integrally molded strap to be received into the strap receiving portion of the container such that the cover is normally inseparable from the container.

The container further includes a flexible attachment portion such that the same may be positioned about or on a strap or belt of the user. Two forms of such attachment portion are illustrated and discussed. The first form of the flexible portion includes a pair of flexible arms fronting against a backing plate with the arms normally providing a holding pressure against the strap or belt arranged between the arms and the backing plate. The second form of the flexible portion includes a generally flat, longitudinally extending, strap or belt receiving passage with one end of the passage being of a smaller dimension than the remainder of the passage and the flexibility of the material will provide a holding pressure upon a belt or strap passed through the passage.

BACKGROUND AND OBJECTS OF THE INVENTION

Photographers or users of cameras are well aware of having run out of film and having to look through an accessory bag to find a new roll of film. In some instances this does not provide any great inconvenience but at other times the searching for the new roll results in a loss of the desired picture.

The applicant provides herein a simple film container which is easily attachable to the users belt or a strap that may be provided on the camera or accessory bag. The container includes a clip which is formed of a flexible material and which will, through pressure, be held in position on the belt or strap.

The applicant is aware of various film containers and these include the structures illustrated in United States Patents issued to Penny, U.S. Pat. Nos. 1,325,372; Mix, 1,467,906; Klein, 3,927,809 and Breslau, 4,180,192. All of these references disclose structures for retaining and carrying a multiplicity of film rolls or cartridges but they do not allow a flexible attachment arrangement for attaching the unit to a belt or carrying strap.

With the container provided by the applicant, a flexible, spreadable clip or slide mechanism is provided for attaching the same and positively holding the same in position upon a carrying strap or belt.

It is therefore an object of the applicant's invention to provide a film carrier or the like which includes a housing and a cover therefore with the cover being attached to the housing through a flexible strap or connector such that the cover is normally inseparable from the housing.

It is a further object of the applicant's invention to provide a film carrier or the like having a housing and a cover element and including a pressure applying attachment clip such that the unit may be attached to a belt or carrying strap and will be held thereon and positioned thereon through the applied pressure.

It is still a further object of the applicant's invention to provide a film carrier or the like having a housing and cover element with a flexible attachment clip which clip may be slightly deformed to receive a belt or strap therein which deformation will, due to the flexibility of the material, result in a pressure being applied to the belt or strap for positioning and attachment of the carrier to the belt or strap.

These and other objects will more fully appear from a consideration of the accompanying description made in conjunction with the accompanying drawings.

DESCRIPTION OF THE INVENTION

Figure 1:
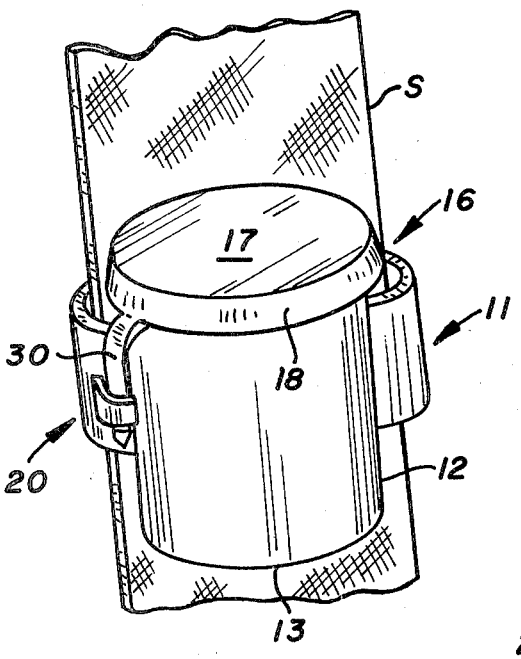
FIG. 1 is a perspective view of a first form of the film carrier embodying the concepts of the applicant's invention and illustrating the same mounted on a carrying strap.

In accordance with the accompanying drawings, a first form of applicant's film carrier is illustrated in FIGS. 1 through 5 and is generally designated 11. The carrier 11 is illustrated on a carrying strap S. Carrier 11 includes a longitudinally extending housing 12 having one closed end 13 and an open end 14 opposite such closed end 13. Arranged around the open end 14 of housing 12 is a radially extending lip 15. Carrier 11 includes a cover or closure element 16 having a substantially flat top portion 17 and a downwardly extending flange 18. An inwardly extending lip 19 is arranged on the downwardly extending flange 18 and the outwardly extending lip 15 and the inwardly extending lip 19 form a snap-type closure arrangement. To obtain such interfit, the applicant has found that a flexible, resilient material is preferred.

An attachment clip structure is provided on the housing 12 and is designated in its entirety 20. In the manufacture of the carrier 11, the clip structure 20 and the housing 12 are integrally molded and are of a plastic material.

Clip 20, in the form shown, includes a first, transversely extending backing plate 21, which backing plate 21 may be directly molded to the housing 12 or may, in the form shown, be attached to the housing 12 through a pair of attachment legs 22*a*, 22*b*.

Figure 2:
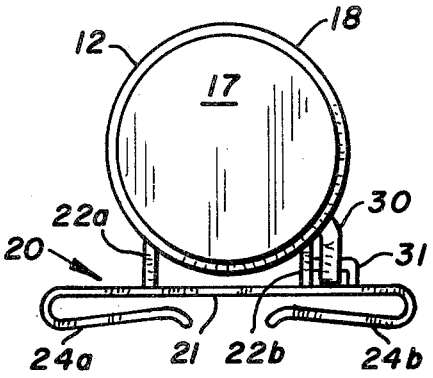
FIG. 2 is a top plan view of the film carrier.
Figure 3:
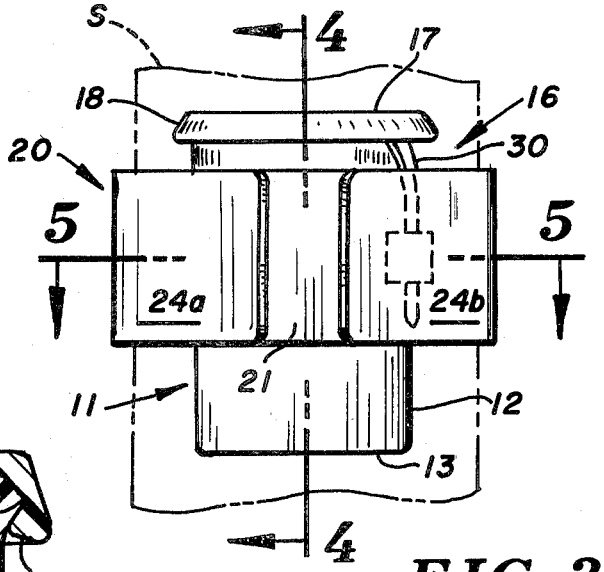
FIG. 3 is an elevation of the carrier taken from the attachment clip side thereof.
Figure 4:
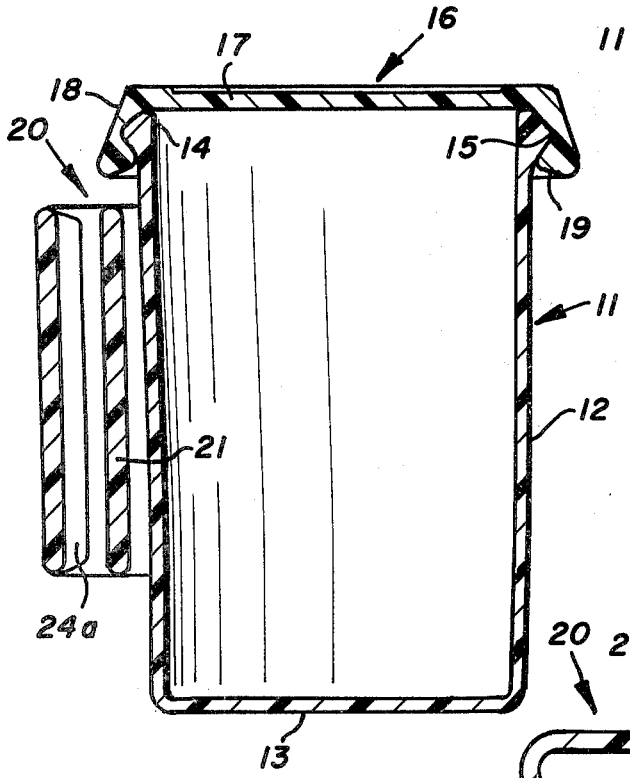
FIG. 4 is a vertical section taken substantially along Line 4—4 of FIG. 3.
Figure 5:
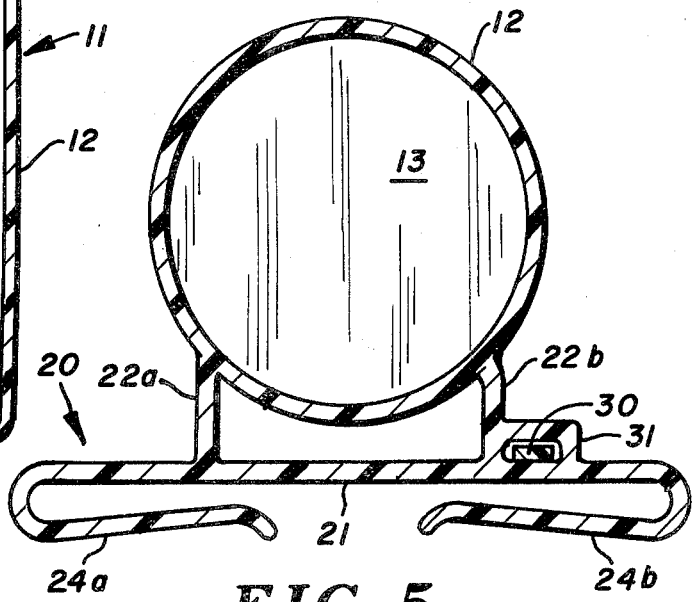
FIG. 5 is a horizontal section taken substantially along Line 5—5 of FIG. 3.
Figure 6:
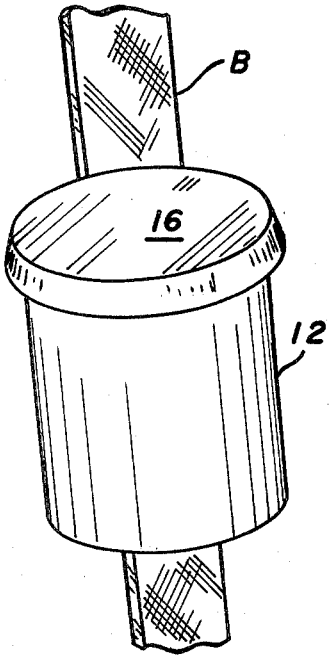
FIG. 6 is a perspective view of a second form of the film carrier embodying the concepts of the applicant's invention and illustrating the same mounted on a carrying strap or belt.
Figure 7:
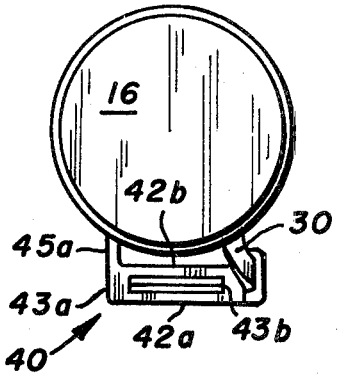
FIG. 7 is a top plan view of the film carrier.
Figure 8:
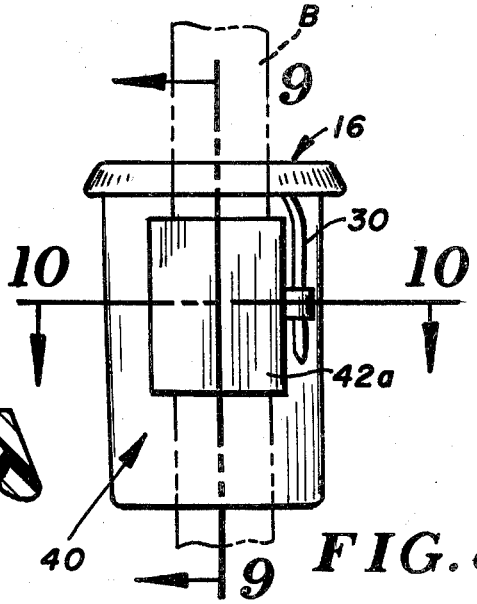
FIG. 8 is an elevation of the carrier taken from the attachment clip side thereof.

As best illustrated in FIGS. 2 and 5, a pair of inwardly directed arms 24*a*, 24*b* are provided on the respective ends of the backing plate and of such a dimension to provide a space between the inwardly directed ends thereof. As illustrated, arms 24*a*, 24*b* are directed towards plate 21 and, as they are formed from a flexible, resilient material they will tend to return to this formed configuration after any deformation such as being spread from plate 21. In this manner then they will provide a clamping force against any member that is of a greater dimension than the original spacing between arms 24*a*, 24*b* and plate 21. Also, as illustrated, the length of plate 21 will allow for straps of relatively large width to be received within the clip structure.

To prevent loss of the cover member 16, a resilient, flexible connector 30 is integrally molded to the cover element 16 and, in the form shown, a U-shaped receiving slot is provided adjacent the backing plate 21. Such slot being formed by an L-shaped section 31 extending from the plate 21 to one of the attachment legs, 22*a* or 22*b*. Strap 30 may be frictionally held within the slot or flexible enlargements could be provided on the end thereof which would permit one-way passage through the slot. It should be obvious that various forms of attachment of the strap 30 to the housing 12 could be provided without departing from the scope of the invention.

The second form of the invention is illustrated in FIGS. 6 through 10. In this form of the invention, the carrier including the housing 12, cover 16 and strap 30 integrally molded to the cover 16 are identical to that described for the first form of the invention and therefore it is not necessary to describe such structure. The primary difference between the first and second form of the invention is in the clip portions thereof. As illustrated in FIG. 6 through 10, the clip is designated 40 and, as illustrated is designed to be attached to a substantially narrower strap or belt B than clip 20.

In the form shown, clip 40 includes a longitudinally extending, generally rectangular passage 41 formed by sides 42*a*, 42*b* and ends 43*a*, 43*b*.

Figure 9:
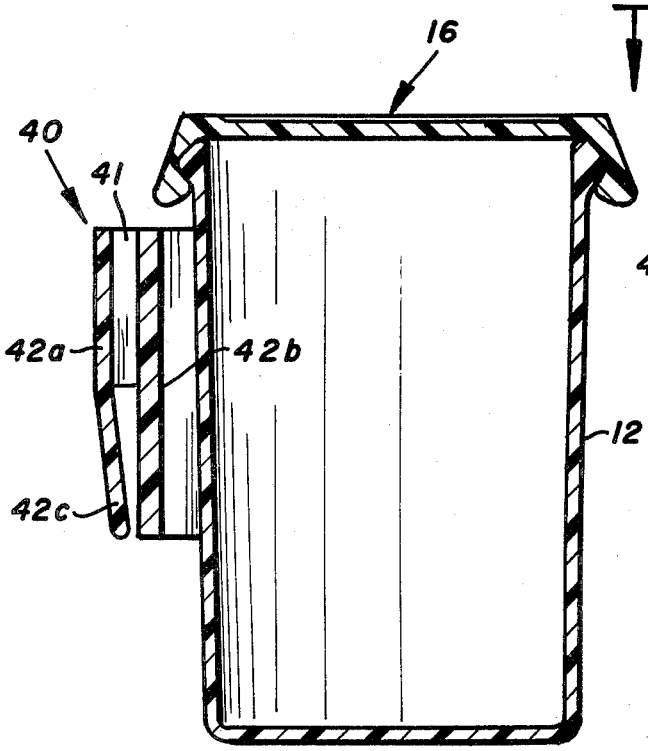
FIG. 9 is a vertical section taken substantially along Line 9—9 of FIG. 8; and, FIG. 10 is a horizontal section taken substantially along Line 10—10 of FIG. 8.
Figure 10:
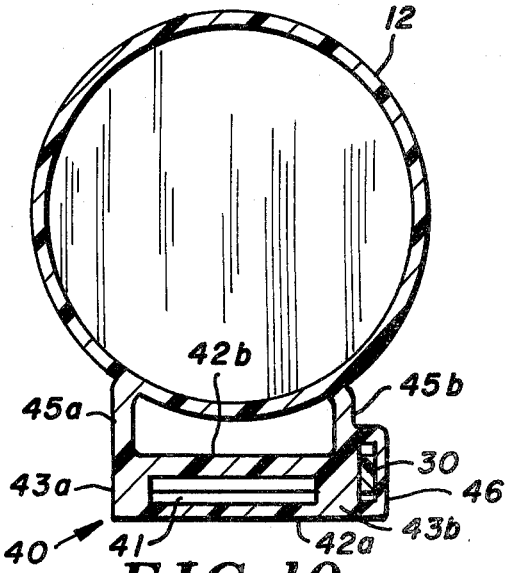

As best illustrated in FIG. 9, the lowermost end 42*c* of side 42*a* is directed inwardly towards side 42*b* such that the passage 41 is decreased in width at selected portions of its length. This decreasing in dimension coupled with the flexibility of the material allows a belt B or the like to be forced therethrough but applies a pressure thereto for clamping and thus positioning of the carrier along the belt B.

As illustrated, the portions of the clip 40 forming the passage may be attached to the housing 12 through attachment legs 45*a*, 45*b* or these portions may be molded directly to the side of the housing 12.

The connective strap 30 is again held to the housing portion to prevent loss of the cap upon opening of the unit and in this instance, a generally U-shaped bracket 46 is provided on one of the ends 43*a*, 43*b* to form a receiving slot for the strap 30. Again, it is not necessary to provide this particular slot for such attachment but it should be obvious that this slot may be integrally molded and no secondary operation for attachment of the strap is necessary.

In either form of the invention it should be obvious that the clip portions provide a pressure unit for clamping against a strap or belt. The flexibility and resiliency of the material and therefore the tendency of the material to return to its formed position provides such clamping action. The resiliency and flexibility of the material also allows the snap connection between the housing and the cover and also provides for the shiftability of the cover from the housing when it is desired to open the carrier.

It should be obvious that the inventor and applicant has provided an improved film carrier which provides not only a film container but also provides a unit which is easily clipped onto a strap or belt and which is positively positionable thereon due to the clamping forces designed into the clip portions thereof.

What I claim is:

1. A carrier for film cartridges and the like, said carrier including:

a. a longitudinally extending housing having a closed end and an open end;

b. a cover member arranged to be received about the open end of said housing;

c. flexible means for attaching said cover to said housing whereby said cover may be removed from said housing to provide access thereto;

d. clip means associated with carrier for retaining the same upon a mounting strap or the like;

e. said clip means including a backing plate secured to said housing and extending transversely the longitudinal dimension of said housing and a pair or flexible and resilient arm members arranged respectively on the ends of said backing plate and directed inwardly thereof to provide a clamping arrangement between said backing plate and said arm members.

2. The structure set forth in claim 1 and said housing provided with a radially extending lip on the open end thereof, said cover member being provided with an inwardly directed lip which lips are engageable and lockable as a snap-type connection.

3. The structure set forth in claim 1 and a receiving slot formed adjacent a selected portion of said housing arranged and constructed to receive said flexible attaching means of said cover.

4. The structure set forth in claim 3 and said receiving slot including an integrally formed member arranged and constructed to receive at least a selected portion of said flexible attaching means to secure said cover to said housing.

* * * * *